US005322015A

United States Patent [19]

Gasparrini

[11] Patent Number: 5,322,015

[45] Date of Patent: Jun. 21, 1994

[54] ROTATING BRUSH CLEANER SYSTEM

[75] Inventor: Charles R. Gasparrini, Portchester, N.Y.

[73] Assignee: Baldwin Technology Corporation, Stamford, Conn.

[21] Appl. No.: 927,238

[22] Filed: Aug. 7, 1992

Related U.S. Application Data

[63] Continuation of Ser. No. 538,120, Jun. 14, 1990, abandoned, which is a continuation of Ser. No. 393,074, Aug. 9, 1989, Pat. No. 4,972,780, which is a continuation of Ser. No. 153,256, Feb. 8, 1988, abandoned.

[51] Int. Cl.[5] ..... B41F 35/00

[52] U.S. Cl. ..... 101/425; 15/256.52; 101/423

[58] Field of Search ..... 101/423, 424, 425; 15/301, 308, 256.5, 256.51, 256.52, 257.2

[56] References Cited

U.S. PATENT DOCUMENTS

| | | | |
|---|---|---|---|
| 5,044,65 | 9/1893 | Beater | 101/167 |
| 1,114,893 | 10/1914 | Lerche | 101/216 |
| 1,378,278 | 5/1921 | Roberts | 101/425 |
| 2,857,290 | 10/1958 | Bolton | 430/126 |
| 3,043,214 | 7/1962 | Christoff | 101/425 |
| 3,049,997 | 8/1962 | Grembecki et al. | 101/425 |
| 3,257,940 | 6/1966 | Strupwick | 101/425 |
| 3,309,993 | 3/1967 | Grembecki et al. | 101/425 |
| 3,835,779 | 9/1974 | Ross et al. | 101/425 |
| 4,015,307 | 4/1977 | Kossak | 15/256.52 |
| 4,072,103 | 2/1978 | Fletcher et al. | 101/151 |
| 4,090,445 | 5/1978 | Sassi | 101/425 |
| 4,134,673 | 1/1979 | Fisher | 355/15 |
| 4,172,303 | 10/1979 | Wooding et al. | 15/256.52 |
| 4,298,268 | 11/1981 | Sato et al. | 355/35 C |
| 4,304,026 | 12/1981 | Borostyan et al. | 15/308 |
| 4,389,936 | 6/1983 | Jaffa et al. | 101/123 |
| 4,393,778 | 7/1983 | Kaneko | 101/425 |
| 4,400,083 | 8/1983 | Beisty et al. | 355/16 |
| 4,667,597 | 5/1987 | Wright et al. | 101/425 |
| 4,704,963 | 11/1987 | Nishimura et al. | 101/425 |
| 4,747,348 | 5/1988 | Jeschke et al. | 101/425 |
| 4,841,862 | 6/1989 | Seefried | 101/425 |
| 4,875,412 | 10/1989 | Wright et al. | 101/425 |
| 4,972,780 | 11/1990 | Gasparrini et al. | 101/425 |
| 5,086,701 | 2/1992 | Gasparrini et al. | 101/425 |

FOREIGN PATENT DOCUMENTS

| | | |
|---|---|---|
| 0119538 | 9/1984 | European Pat. Off. . |
| 0312827 | 4/1989 | European Pat. Off. . |
| 0328369 | 8/1989 | European Pat. Off. . |
| 0369565 | 5/1990 | European Pat. Off. . |
| 0243051 | 6/1911 | Fed. Rep. of Germany . |
| 0420696 | 10/1925 | Fed. Rep. of Germany . |
| 1234430 | 2/1961 | Fed. Rep. of Germany . |
| 2013563 | 3/1970 | Fed. Rep. of Germany . |
| 3120983 | 5/1981 | Fed. Rep. of Germany . |

(List continued on next page.)

OTHER PUBLICATIONS

Xerox Disclosure Journal, "Guard at the Developer System to Protect Against Foreign Objects", Brockway, vol. 1, No. 6, 1976.

Xerox Disclosure Journal, "Pinchoff Helical Brush Cleaner", Tolliver, vol. 1, No. 8, Aug. 1976, p. 69.

Xerox Disclosure Journal, "A Cleaning System", Hewitt, vol. 3, No. 4, Jul./Aug. 1978, p. 253.

IBM Tech. Discl., "Cleaner-to-Developer Tofner Recirculation", Eide and Witte, vol. 21, No. 5, Oct. 1978, p. 1784.

(List continued on next page.)

*Primary Examiner*—Edgar S. Burr
*Assistant Examiner*—Christopher A. Bennett
*Attorney, Agent, or Firm*—Morgan & Finnegan

[57] ABSTRACT

A rotating brush cleaning system is provided for removing debris, lint and ink from components of printing devices. Operation is effected by an air cylinder which periodically urges a rotating spiral brush cleaner against the component of the printing device and retracts the cleaner from the component of the printing device. The action of the cleaner in combination with rotation of the component of the printing device is such as to loosen dust and lint from the component, which dust and lint is then drawn into a vacuum system that surrounds the cleaner.

18 Claims, 7 Drawing Sheets

FOREIGN PATENT DOCUMENTS

| | | |
|---|---|---|
| 3601539 | 1/1986 | Fed. Rep. of Germany . |
| 1216252 | 4/1960 | France . |
| 2117385 | 7/1972 | France . |
| 0127178 | 6/1972 | Norway . |
| 0127179 | 6/1972 | Norway . |
| 0054337 | 10/1910 | Switzerland . |
| 0359719 | 3/1962 | Switzerland . |

OTHER PUBLICATIONS

IBM Tech. Discl., "Xerographic Cleaning Station", Richert and Van Wert, vol. 25, No. 1, Jun. 1982, p. 255.

Xerox Discl. Journal, "Blade Cleaner Seal for Magnetic Brush Cleaner", Lindblad et al., vol. 8, No. 4, Jul. 1983, p. 359.

Xerox Discl. Journal, "Flexible Cleaner Seal", McCarroll, vol. 8, No. 5, Sep./Oct. 1983, p. 431.

ROTATING BRUSH CLEANER SYSTEM

CROSS-REFERENCE TO RELATED APPLICATIONS

This application is a continuation of application Ser. No. 538,120, filed Jun. 14, 1990 now abandoned, which was a continuation-in-part of Applicant's copending application Ser. No. 07/393,074, filed Aug. 9, 1989, now U.S. Pat. No. 4,972,780, issued Nov. 27, 1990, which itself was a continuation of application Ser. No. 07/153,256, filed Feb. 8, 1988, now abandoned.

BACKGROUND OF THE INVENTION

This invention relates to cleaning apparatus in the graphic arts industry and, in particular, to a spiral brush apparatus for cleaning printing press components.

Devices employed in the printing industry become contaminated with debris such as ink and lint. This problem occurs whether the printing is on paper or fabrics. The debris also forms, to varying degrees, on all kinds of printing equipment. For example, offset printing has become the predominant printing method in the newspaper publishing industry.

Offset printing presses typically employ a blanket cylinder, that is to say, a rubber cylinder or a rubber-covered cylinder, for the purposes of receiving inked images from a printing plate. The inked images are then offset onto paper passed between the blanket cylinders or impression cylinder and blanket cylinder. Continuous printing is made possible by wrapping a print plate or a plurality of printing plates around the surface of a plate cylinder designed for rotation in contact with the blanket cylinder.

In operating blanket-to-blanket presses, a web of paper passes between two blanket cylinders mounted such that one blanket cylinder serves as an impression cylinder for the other. This results in "perfecting" which is simultaneous printing on both sides of the web of paper.

Continuous offset printing is adversely affected by dust and lint from the web of paper which tend to accumulate on the blanket cylinder(s). This dust and lint reduces the quality of the printed product. The accumulation of dust, lint or ink on a blanket cylinder thus presents a serious annoyance and necessitates undesirable down-time for cleaning. The problem is especially acute in the newspaper industry, when, in response to the rising cost of newsprint stock, less expensive grades of paper having higher lint content often are substituted for more expensive grades.

The problem of collection of debris such as ink, dust and lint on printing devices is not limited to offset printing. It occurs in press equipment in general. For example, it occurs on Anilox Rollers, Flexo Plate Cylinders and Plates, pipe rollers in newspaper presses, metal decorating press blanket cylinders, rollers and impression cylinders, Gravure press cylinders and rollers, Flexo press cylinders and rollers, and textile printing plates, blankets and rollers. The problem of cleaning printing equipment is well known as indicated by prior efforts for printing equipment cleaner devices.

In some types of printing, sheets are cut and stacked prior to printing. The sheets are prevented from sticking by application of a dusty material such as corn starch. Use of corn starch laden sheets provides another source of debris.

Previously known vacuum devices for cleaning blanket cylinders involved wet vacuum systems for removing debris. In these systems, segments of the blanket cylinder are continually immersed and cleaned with a solvent. See, for example, U.S. Pat. Nos. 3,049,997 and 3,309,993 to Grembechi et al. and 3,835,779 to Ross et al. The present invention avoids the need for solvents by employing a completely dry system for removing debris.

Additionally, the present invention employs a separate vacuum or air flow means unlike the IBM Technical Disclosure Bulletin, "Cleaner to Developer Toner Recirculation," Eide and Witte, Vol. 21, No. 5, October 1987, pp 359–360 that discloses only a slight vacuum caused by the rotation of the brush.

Lastly, this invention has arms to pivot the rotating brush cleaner between two operative positions as well as means to vary the rotation of the brush means to increase its cleaning effectiveness, unlike U.S. Pat. No. 4,134,673 to Fisher and Xerox Technical Disclosure Bulletin, "A Cleaning System," Hewitt, Vol. 3, No. 4, July/August 1978, pp 253–254.

OBJECTS AND STATEMENT OF THE INVENTION

It is, therefore, an object of the present invention to provide an improved apparatus to clean debris comprising ink, lint and/or dust from components of printing devices.

It is another object of the present invention to provide a rotating brush cleaner for cleaning cylindrical components of printing devices.

A further object of this invention is to provide a rotating brush cleaner that requires no drive system.

A further object of this invention is to provide a rotating brush cleaner that has a wide range of cleanability.

A further object of this invention is to provide a rotating brush cleaner in which press windage and brush removal direction are the same, allowing debris to be moved to the vacuum source.

Yet another object of this invention is to provide a rotating brush cleaner that is easily constructed.

Still another object of this invention is to provide a rotating brush cleaner which operates to provide radial and lateral cleaning effect.

In accordance with this invention, generally stated, an apparatus for cleaning components of printing devices, such as a rotating blanket cylinder of an offset printing press, is provided, having a spiral brush and brush holder which is periodically urged against the cylindrical component of a printing device by the motion of a pivoting arm connecting the cleaning means with an air cylinder.

When the spiral brush is engaged, the brushes rotate in the same direction as the cylindrical component. The action of the spiral brush in combination with rotation of the cylindrical component is such as to loosen dust and lint from the component. The dust and lint is then drawn into a vacuum system which includes a housing that surrounds the spiral brush.

The spiral brush action is of particular importance. The interference of the bristles on the spiral brush with the cylindrical component causes each bristle to flex radially, flicking the debris and lint off the cylindrical component and to the vacuum source area. In addition to radial flicking, the spiral in the brush causes lateral movement of bristles as the brush rotates, thus effecting additional cleaning.

These spiral brushes may also be segmented to allow portions of the brushes to be independently engaged and disengaged as needed. Alternatively, the brushes may be laterally adjustable so that they align with printing components of varying dimensions.

The frequency of the automatic engagement and operation of the rotating brush cleaner of this invention is adjustable by a press operator in response to various anticipated or observed parameters such as lint content of the paper stock and length of the press run.

The invention further includes means in the housing adapted to engage the spiral brush and serve the dual function of loosening dirt and lint from the spiral brush and varying the speed of the rotating spiral brush. The invention may also include means in the housing adapted to engage the cylindrical component and seal the vacuum system. Additionally, the spiral brush can vary in spiral angle and brush bristle diameter to alter brush speed when the spiral brush is in the engaged position.

The foregoing and other objects, features and advantages of the present system will be apparent to those skilled in the art in light of the following description of preferred embodiments in connection with the accompanying drawings.

DESCRIPTION OF PREFERRED EMBODIMENTS

Figure 1:
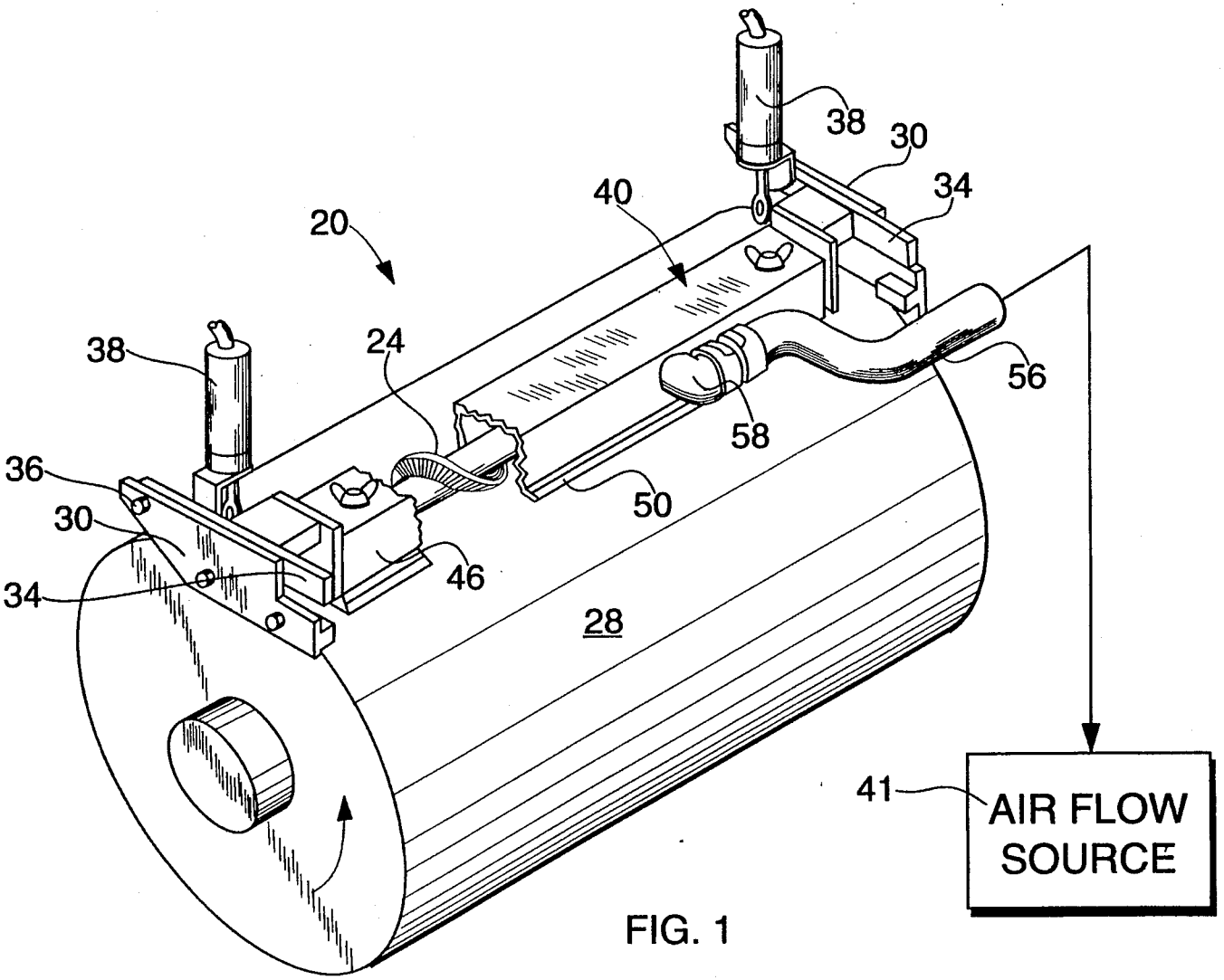
FIG. 1 is a side perspective view, in partial cross-section, of a rotating brush cleaner system constructed in accordance with one embodiment of the present invention.

Referring now to the drawings, and, in particular, to FIG. 1, there is shown a rotating brush cleaner system in accordance with one embodiment of the present invention. The rotating brush cleaner, shown generally at 20, includes at least one spiral brush 24, a housing 40 and an airflow means 41.

The rotating brush cleaner in accordance with this embodiment of the present invention is mounted in operative association with a blanket cylinder 28, generally parallel to a longitudinal axis of the blanket cylinder. Rotating brush cleaner mounting brackets 30 are attached to the press frame (not shown) generally outside either end of the blanket cylinder 28. Pivoting arms 34 connect the rotating brush cleaner 20 with mounting brackets 30. These pivoting arms 34 serve to carry the rotating brush cleaner 20 and are pivotal about pin 36.

The rotating brush cleaner is generally pivotal between two operative positions. Pivoting of said arms 34 between these positions is affected by a plurality of actuators 38 attached to pivot arms 34. Preferably, the actuator employed is a pneumatic actuator, although manual, electrical or hydraulic actuators can be used if desired. Conventionally, a pneumatic actuator is used because compressed air is commonly available in the press rooms.

In the first operative position, rotating brush cleaner 20 is biased away from the blanket cylinder 28 to facilitate, for example, replacement of the spiral brushes and/or repair or maintenance of the machine.

In the second operative position, the rotating brush cleaner 20 is held in contact with the surface of the blanket cylinder 28. In this second position, the rotating brush cleaner can affect cleaning and removal of the lint and debris from the blanket cylinder.

The vacuum portion of one embodiment of the rotating brush cleaner 20 is generally comprised of a substantially U-shaped housing 40 extending along the length of the blanket cylinder and a spiral brush 24. The spiral brush 24 is mounted inside housing 40 which in turn is mounted to pivot arms 34.

In the engaged second position, the spiral brush 24 is driven by the blanket cylinder 28 and thus, rotates in the same direction as the blanket cylinder 28. The amount of interference the spiral brush 24 and blanket cylinder 28 have in the engaged second position can be varied, as required, to improve the ability of the spiral brush 24 to loosen and remove lint and debris from the blanket cylinder.

Figure 5:
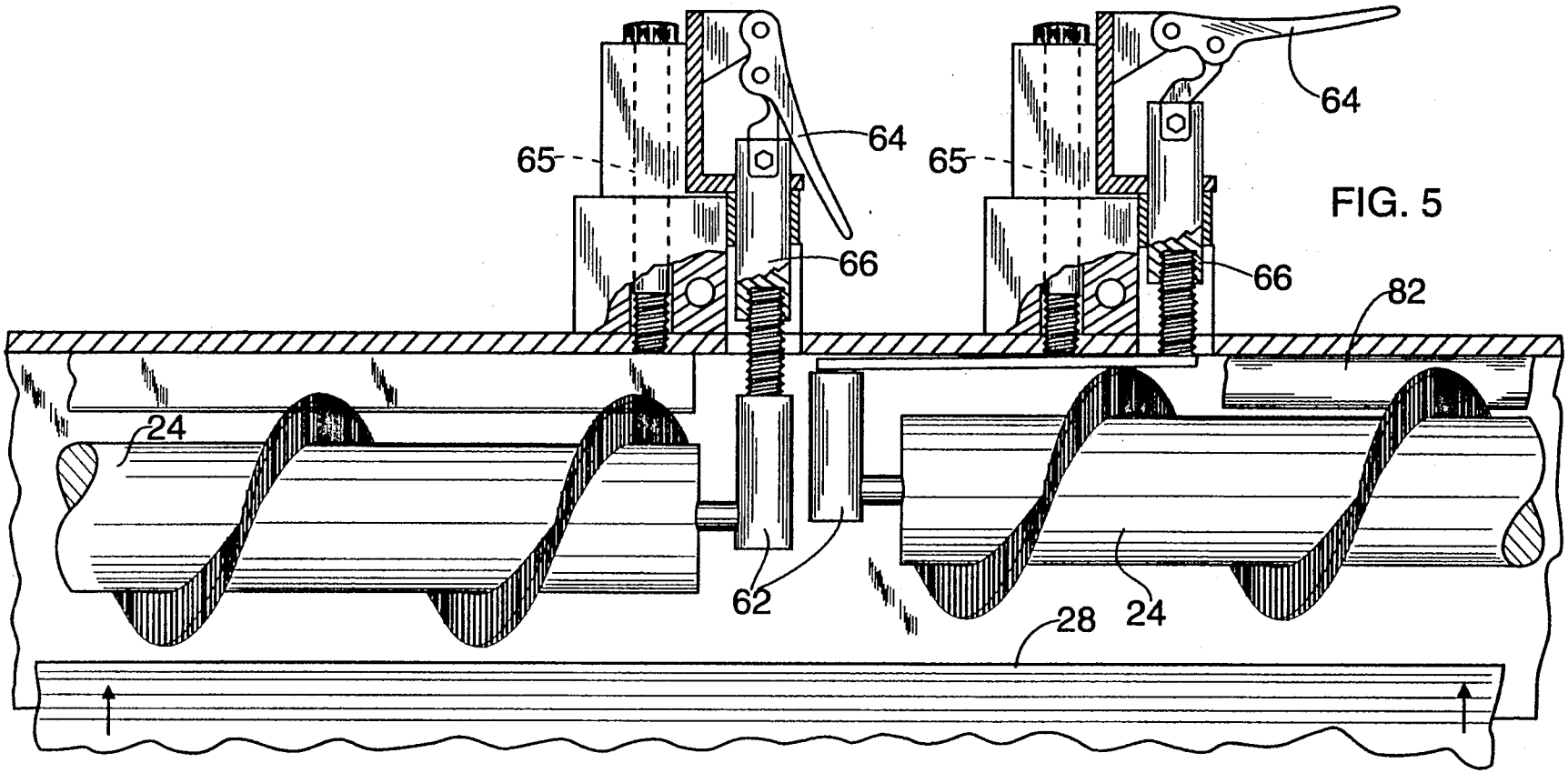
FIG. 5 is a front view in cross-section of a brush assembly having segmented brushes wound in the same direction.

Referring now to FIG. 5 there is shown an alternate embodiment for the rotating brush cleaner. In FIG. 5, the brush holder 62 is segmented to allow individual sections to be lifted so as not to contact the blanket cylinder during cleaning. Segmenting can be desirable since newspaper blanket cylinders are generally set up in quarters or pages; i.e., a web can be double width (full blanket) or single width (half blanket). If a single width is used, ink can get onto the cylinder that does not have web covering it. When that occurs, ink can foul a continuous brush in the non-web area. Segmenting the brushes, preferably into four sections, permits the brushes in the unused area to be lifted away. The rotating brush cleaner may be segmented into as many sections as desired to provide for maximum versatility. Also, lifting the brushes may be accomplished by any effective means and can be done either manually, as shown, pneumatically, electrically or mechanically.

Figure 6:
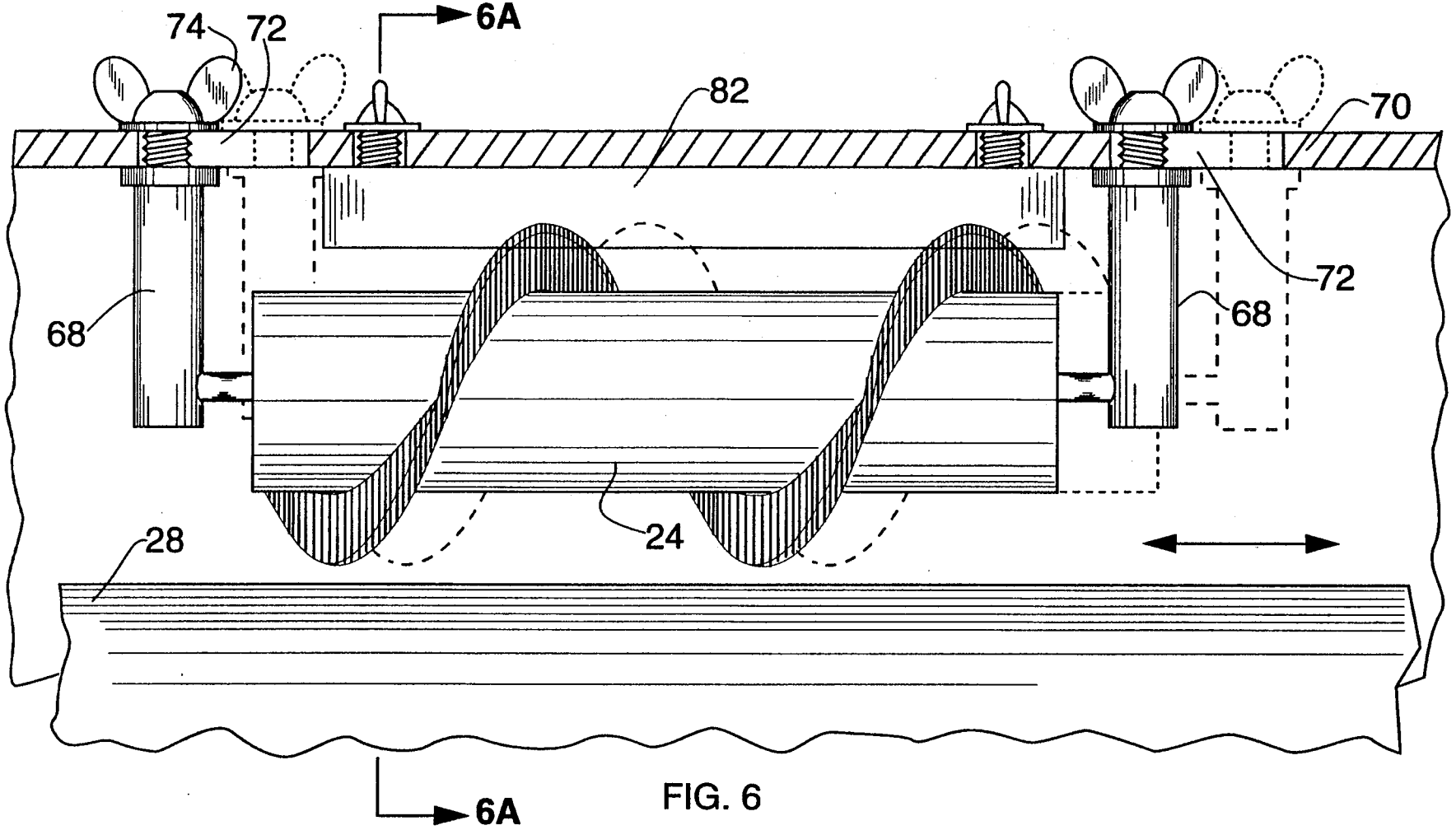
FIG. 6 is a front view in cross-section of a brush assembly having laterally adjustable brushes.

In the case of commercial web presses, segmenting of the brushes may not be feasible. This is because the web being operated on may vary greatly in width. For such applications the brush assembly can be made laterally adjustable along the width of the blanket cylinder. See FIG. 6. In the embodiment shown in FIG. 6, brush holder 68 is slideably mounted within housing 70 along slots 72. Locking means 74 serve to maintain the brushes in the desired lateral location. In this fashion the brushes may be aligned for the particular application to be performed.

A variety of materials can be used for spiral brushes 24, provided that they do not damage the surface of the blanket cylinder 28. These materials include both natural and synthetic fibers. The spiral brushes can be spiraled in different directions and can range in pitch from about ⅛ inch to 1 inch, preferably ⅛ inch to ⅜ inch. The stiffness of the bristles can be varied by choosing different length and diameter bristles. In varying the spiral angle and bristle diameter of the spiral brushes, the speed of rotation of these brushes in the engaged second positon is varied. The spiral wound, round brushes can also vary in diameter; preferably the diameter is 2 inches to 3 inches.

Housing 40, (FIG. 4) in the form of an inverted U-shaped channel, has a top surface 44 and parallel side, 46 and 48 respectively. Housing 40 is mounted between pivot arms 34 in a downward position with the open end facing the blanket cylinder 28. Alternatively, U-shaped channel 40 may be mounted forward or backward relative to the centerline of the blanket cylinder 28 as desired.

Figure 6A:
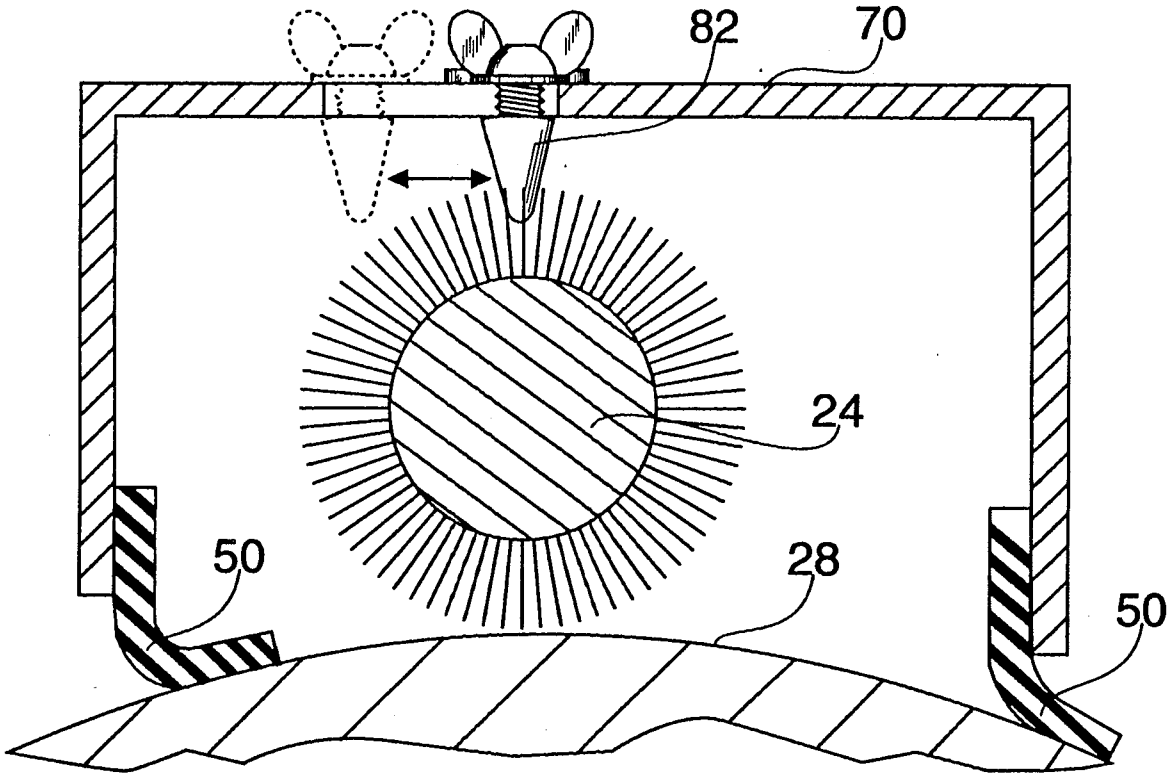
FIG. 6A is a side view in cross-section of a brush assembly having an adjustable flicker blade.

A flicker blade 82 (FIG. 4) is mounted to the surface of housing 40 and is parallel to sides 46 and 48 of the housing. The flicker blade 82 engages spiral brush 24 and can be adjusted, as in FIG. 6A, to vary its interference with spiral brush 24. By varying the interference, the speed of rotation of the spiral brush can be varied. When the speed of the rotating spiral brush 24 is differentially slower than the speed of the rotating blanket cylinder, removal of lint and debris is more effectively accomplished.

Flexible wipers 50 (FIG. 4) are positioned at the ends of sides 46 and 48 of housing 40 and serve to contact the surface of blanket cylinder 28 to provide sealing surfaces in contact with the blanket cylinder when the rotating brush cleaner is engaged.

Loosened lint and debris 52 (FIG. 4) are removed from the interior of housing 40 by means of an airflow source, such as by vacuum or air pressure. An airflow generating machine 41 (FIG. 1) is connected to port 58 in housing 40 by hose 56. Lint and debris 52 are conveyed through hose 56 by means of the airflow to be deposited in an appropriate disposal unit (not shown).

Figure 7:
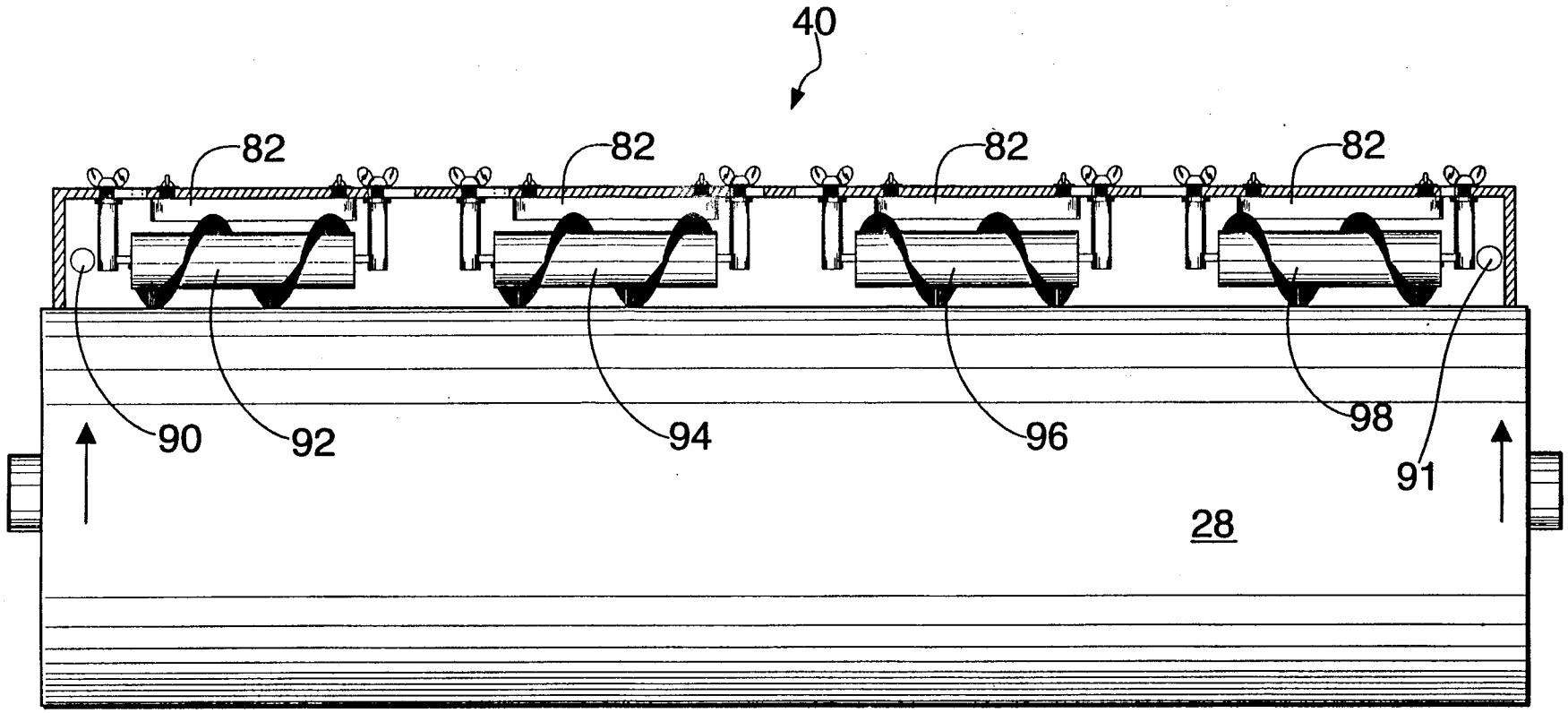
FIG. 7 is a front perspective view of a brush assembly having segmented brushes wound in opposite directions.

In FIG. 7 there is shown another alternate embodiment for the rotating brush cleaner. Spiral brushes are segmented into four segments in housing 40. The two brushes 92 and 94 contained in the left side of housing 40 are be spiraled so that the rotation of the brushes drives the debris to port 90 on the left end of housing 40. The two brushes 96 and 98 in the right side of housing 40 are sprialed in the opposite direction so that the same mechanical and windage effect drives the debris to a second port 91 on the right end of housing 40. In this way, the rotating brushes remove the debris and drive it to the ports for better removal. Also the spiraling on the brushes can be altered to direct flow of the debris in different directions; for example, to only one end of the housing.

Figure 2:
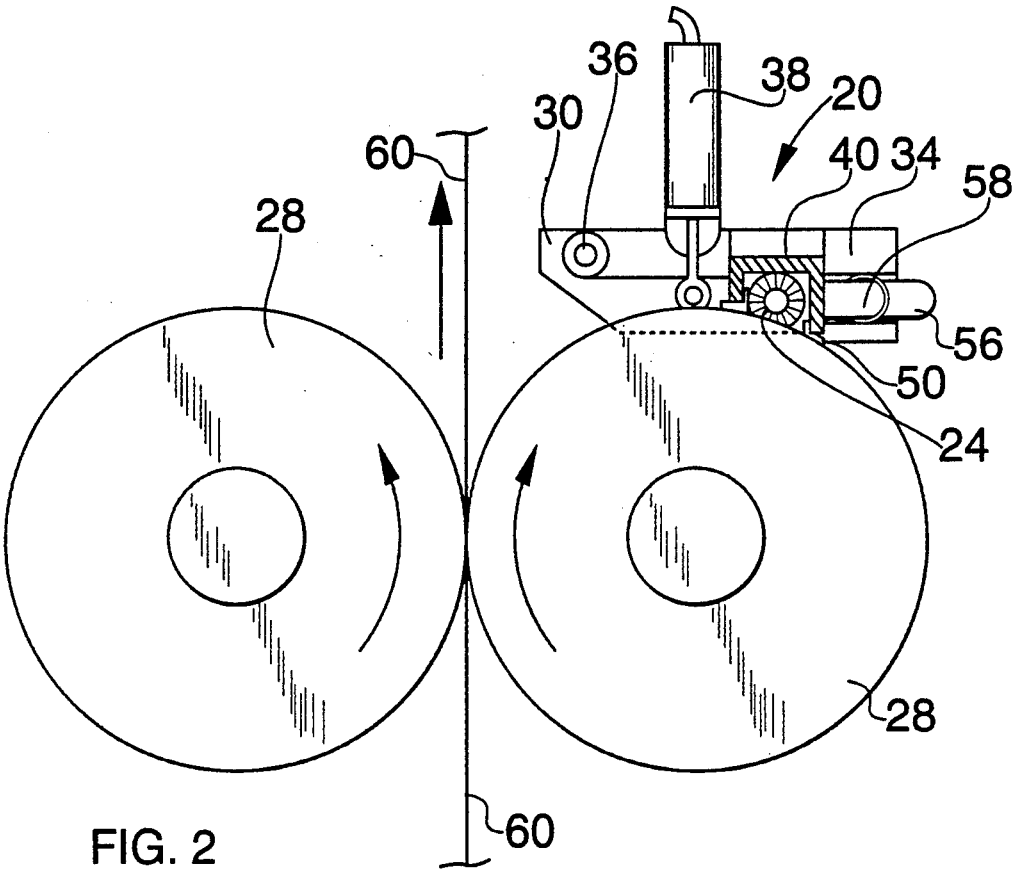
FIG. 2 is a side view of the rotating brush cleaner system in the engaged position.
Figure 3:
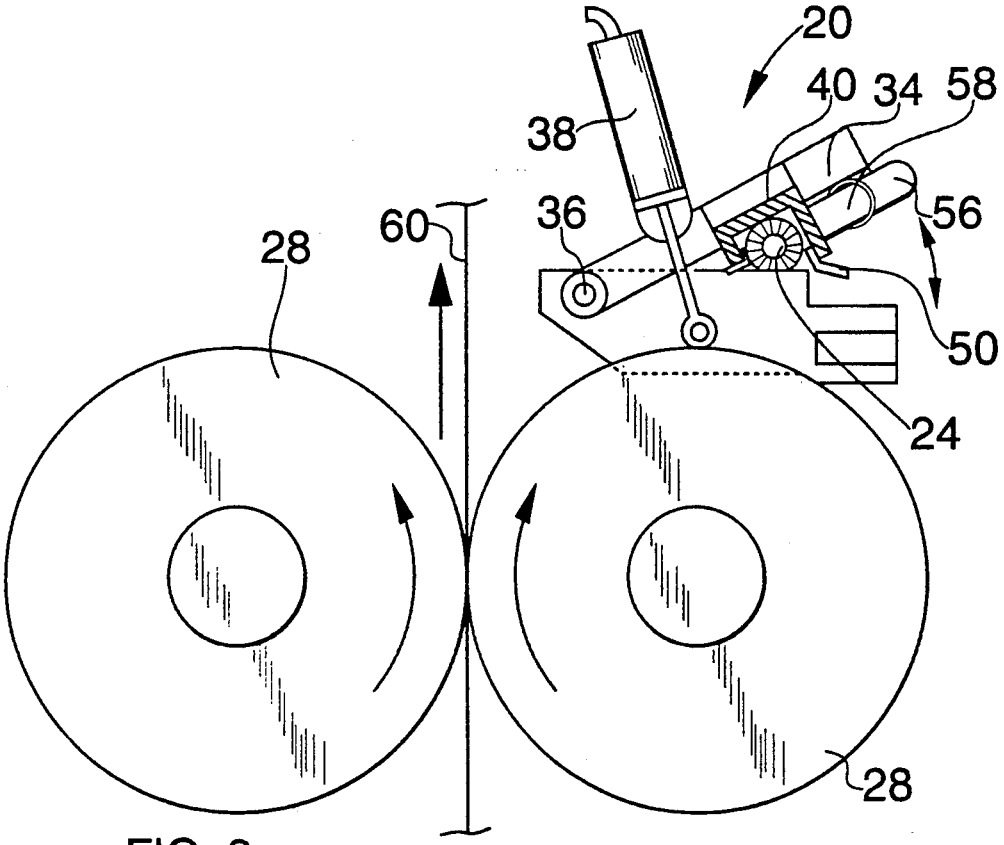
FIG. 3 is a side view of the rotating brush cleaner system in the disengaged position.
Figure 4:
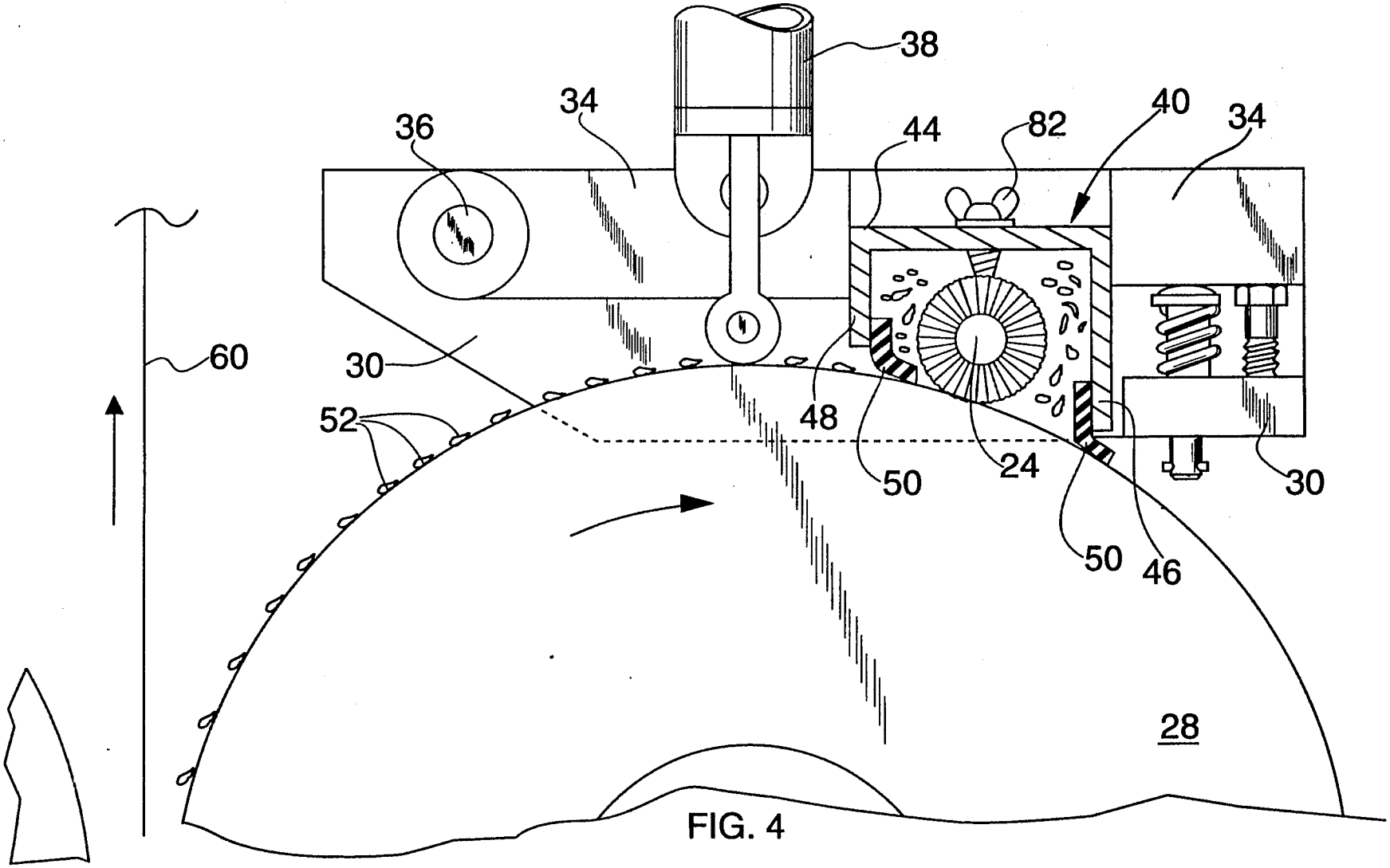
FIG. 4 is an enlarged side view, in cross-section, of the rotating brush cleaner system in accordance with one embodiment of the present invention.

Referring now to FIGS. 2–4, there is shown the general operation of the blanket cleaner in accordance with a blanket to blanket press embodiment of the present invention. A web of imprinting material 60 passes between counterrotating blanket cylinders 28 and is imprinted on both front and rear sides of the web. In the course of this imprinting operation, lint and debris 52 from the web 60 accumulate on the surface of the blanket cylinders 28 and, if allowed to remain thereon, tend to reduce the overall quality of the printed product.

In order to remove this lint and debris from the surface of the blanket cylinders 28, rotating brush cleaners 20, generally located atop the blanket cylinders 28, are biased against the cylinders by biasing means in the form of actuators 38. Generally, it is not necessary that the rotating brush cleaners 20 be continuously in contact with blanket cylinders 28 throughout the imprinting operation, however, where an excessive amount of lint and debris accumulate rather quickly, it may be desirable to leave them engaged during operation of the press. Under normal operating conditions the rotating brush cleaners 20 are periodically actuated against the blanket cylinders for a predetermined time to effect cleaning of the surface.

Periodic operation of the blanket cleaner of this invention may be controlled by conventional timing mechanisms related either to rotation of the presses or on command of the operator. In any case, the operation of the actuator is controlled so that when blanket cleaning is desired, the actuator 38 is operated so that the cleaner is moved from the disengaged position (FIG. 3) to the engaged position (FIG. 2). In the engage position the spiral brushes 24 are brought into contact with the surface of blanket cylinder 28. The spiral brushes 24 are utilized to remove debris and lint from the blanket cylinder 28, and after a predetermined number of rotations, the actuator 38 is operated to cause the rotating brush cleaner to disengage as shown in FIG. 3.

While engaged, lint and debris that are loosened and dislodged by the brushes 24 are drawn off and disposed of by the vacuum system. This effectively removes the lint and debris from the blanket cylinder during the imprinting operation.

The particular embodiment just described is preferred because of the ease of installation and adjustment provided by the construction described. For example, the various working parts are located physically above the blanket cylinder 28, and thus are readily accessible both for installation and maintenance.

The rotating brush cleaner can be employed in the printing industry to clean a wide variety of press and printing equipment in general. Examples of such equipment include the following: blanket cylinders, impression cylinder, Anilox rollers, Flexo plate cylinders and plate, pipe rollers in newspaper presses, metal decorating press blanket cylinders, rollers, and impression cylinders, Gravure press cylinders or rollers, Flexo press cylinders or rollers, and textile printing plates, blankets or rollers, or gripper bar cleaners. Possibilities for cleaning in the graphic arts field are vast and encompass the following areas: lithography (offset), Flexography, Gravure, Intaglio and letter press.

The foregoing is considered as illustrative only of the principles of the present invention and is not limited to the particular embodiments discussed herein. Various changes, substitutions and modifications may be made thereto by those skilled in the art without departing from the spirit or scope of the invention defined by the appended claims.

What is claimed:

1. A dry mechanical rotating brush system for removing dirt and lint from a cylindrical component of a printing device, said cleaning system comprising:

(a) a mounting frame attached to a press frame adjacent said cylindrical component;

(b) arm means movable connecting said mounting frame and said press frame;

(c) brush housing means attached to said movable arm means and adapted to extend along the length of said cylindrical component;

(d) said housing means being adapted to enclose a portion of said cylindrical component;

(e) means for moving said arm means to and from a first position away from said cylindrical component and to and from a second position adjacent said cylindrical component;

(f) spiral brush means mounted within and enclosed by said housing means and adapted to engage said cylindrical component when said spiral brush means is in said second position;

(g) air flow means in cooperative relationship with said housing to establish a flow path within said housing at predetermined times whereby said spiral brush means will loosen dirt and lint from said rotating cylindrical component permitting said air flow means and housing to remove such dirt and lint; and (h) flicker blade means mounted within and parallel to said housing means and adapted to engage said spiral brush means.

2. A system as defined in claim 1 wherein said spiral brush means includes a spiral pitch of about ½ to about ¾ inches and spiral brush diameter of about 2 to about 3 inches.

3. A system as defined in claim 1 wherein said housing means includes sealing means extending from said housing into contact with said cylindrical component to provide a sealing surface between said cylindrical component and said housing when said cleaner is in said second position adjacent said cylindrical component.

4. A system as defined in claim 1 wherein said spiral brush means is segmented into sections, which sections are separable moveable between a first position away from said cylindrical component and a second position adjacent said cylindrical component.

5. A system as defined in claim 4 wherein said moving means are operated pneumatically.

6. The system as defined in claim 5 wherein said spiral brushes are all spiraled in the same direction.

7. The system as defined in claim 5 wherein at least two spiral brushes are spiraled in opposite directions.

8. A dry mechanical rotating brush system for removing dirt and lint from a blanket cylinder, said cleaning system comprising:

(a) a mounting frame attached to a press frame adjacent said blanket cylinder;

(b) arm means movably connecting said mounting frame and said press frame;

(c) brush housing means attached to said movable arm means and adapted to extend along the length of said blanket cylinder;

(d) said housing means being adapted to enclose a portion of said blanket cylinder;

(e) means for moving said arm means to and from a first position away from said blanket cylinder and to and from a second position adjacent said blanket cylinder;

(f) spiral brush means mounted within and enclosed by said housing means and adapted to engage said blanket cylinder when said spiral brush means is in said second position;

(g) air flow means in cooperative relationship with said housing to establish a flow path within said housing at predetermined times whereby said spiral brush means will loosen dirt and lint from said rotating blanket cylinder permitting said air flow means and housing to remove such dirt and lint; and (h) flicker blade means mounted within and parallel to said housing means and adapted to engage said spiral brush means.

9. A system as defined in claim 8 wherein said spiral brush means includes a spiral pitch of about ½ to about ¾ inches and spiral brush diameter of about 2 to about 3 inches.

10. A system as defined in claim 8 wherein said housing means includes sealing means extending from said housing into contact with said blanket cylinder to provide a sealing surface between said blanket cylinder and said housing when said cleaner is in said second position adjacent said blanket cylinder.

11. A system as defined in claim 8 wherein said spiral brush means is segmented into sections, which sections are separable moveable between a first position away from said blanket cylinder and a second position adjacent said blanket cylinder.

12. A system as defined in claim 11 wherein said moving means are operated pneumatically.

13. The system as defined in claim 12 wherein said spiral brushes are all spiraled in the same direction.

14. The system as defined in claim 12 wherein at least two spiral brushes are spiraled in opposite directions.

15. In an offset printing press having a blanket cylinder adapted to rotate about a longitudinal axis, the improvement which comprises a dry mechanical rotating brush system for removing dirt and lint from the blanket cylinder during an uninterrupted course of a press run, said system including spiral brush means operatively mounted to said press, said spiral brush means including at least one brush mounted for movement between at least a first position where said spiral brush means is in contact with said blanket cylinder and a second position where said spiral brush means is remote from said blanket cylinder, means for moving said spiral brush means between said first and second positions; enclosure means surrounding said spiral brush means and enclosing a portion of the blanket cylinder when the spiral brush means is in contact with said blanket cylinder; air flow means communicating with said enclosure means and establishing a flow path within said enclosure means for removing dislodged debris from said blanket cylinder; and flicker blade means mounted within and parallel to said housing means and engaging said spiral brush means.

16. An offset printing press, as defined in claim 15, wherein said spiral brush means is adjustable relative to said enclosure means.

17. An offset printing press, as defined in claim 15, wherein sealing means are extended from said enclosure means and engage said blanket cylinder when said brush means is in contact with said blanket cylinder for substantially sealing off the flow path with said enclosure means.

18. An offset printing press, as defined in claim 15, wherein said spiral brush means includes a spiral pitch of about ½ to about ¾ inches and spiral brush diameter of about 2 to about 3 inches.

* * * * *

UNITED STATES PATENT AND TRADEMARK OFFICE

CERTIFICATE OF CORRECTION

PATENT NO. : 5,322,015

DATED : June 21, 1994

INVENTOR(S) : Charles R. Gasparrini, et al

It is certified that error appears in the above-indentified patent and that said Letters Patent is hereby corrected as shown below:

The term of this patent subsequent to November 27, 2007 has been disclaimed.

Claim 1, column 6, line 62 "movable" should read --movably--.

Signed and Sealed this

Eighth Day of November, 1994

*Attest:*

Bruce Lehman

BRUCE LEHMAN

*Attesting Officer*

*Commissioner of Patents and Trademarks*